US007621627B2

(12) United States Patent
Ohashi et al.

(10) Patent No.: US 7,621,627 B2
(45) Date of Patent: Nov. 24, 2009

(54) LIQUID CONTAINER

(75) Inventors: Tetsuya Ohashi, Matsudo (JP); Ryoji Inoue, Kawasaki (JP); Hideki Ogura, Yokohama (JP); Shogo Kawamura, Numazu (JP); Yasuo Kotaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 554 days.

(21) Appl. No.: 11/467,290

(22) Filed: Aug. 25, 2006

(65) Prior Publication Data

US 2007/0052768 A1 Mar. 8, 2007

(30) Foreign Application Priority Data

Sep. 2, 2005 (JP) ..... 2005-255198

(51) Int. Cl.
*B41J 2/175* (2006.01)

(52) U.S. Cl. ..... 347/86

(58) Field of Classification Search ..... 347/84, 347/85, 86, 87; 399/237
See application file for complete search history.

(56) References Cited

U.S. PATENT DOCUMENTS

| | | | | |
|---|---|---|---|---|
| 3,876,282 | A * | 4/1975 | Schon et al. | 399/238 |
| 4,664,815 | A * | 5/1987 | Ozawa et al. | 210/96.1 |
| 5,918,093 | A * | 6/1999 | Kim | 399/237 |
| 6,151,469 | A * | 11/2000 | Lee | 399/237 |
| 6,341,209 | B1 * | 1/2002 | Kim et al. | 399/237 |

FOREIGN PATENT DOCUMENTS

| | | |
|---|---|---|
| JP | 2004-216761 | 8/2004 |
| JP | 2005-066520 | 3/2005 |
| JP | 2005-067094 | 3/2005 |

* cited by examiner

*Primary Examiner*—Anh T. N. Vo
(74) *Attorney, Agent, or Firm*—Canon USA Inc IP Div

(57) ABSTRACT

A liquid container having a liquid containing portion adapted to contain a liquid, a supplying portion facilitating supplying the liquid from the liquid containing portion to outside, and an agitating member configured to agitate the liquid, in which the agitating member has a bending portion.

6 Claims, 14 Drawing Sheets

FIG.8A
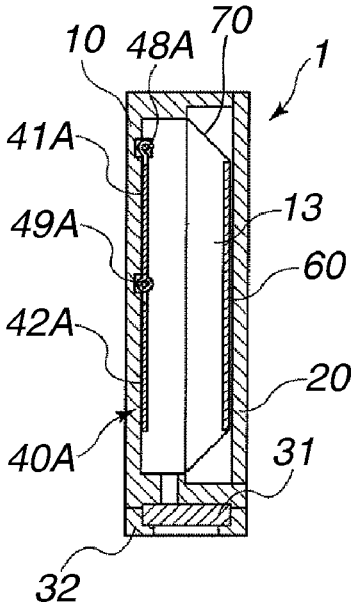
FIG.8B FIG.8C FIG.8D
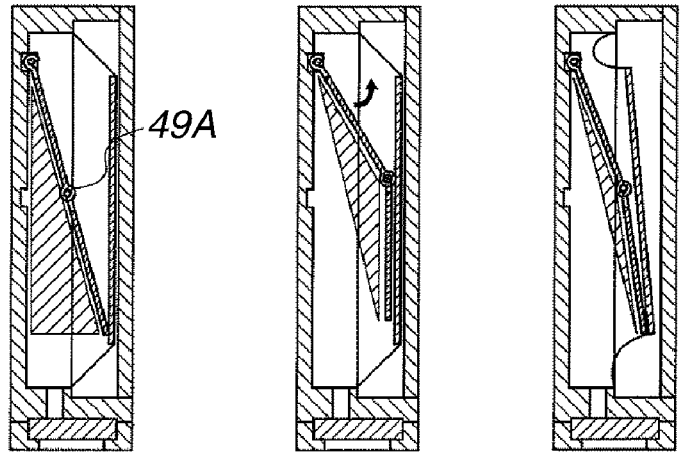
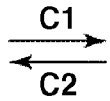
FIG.9
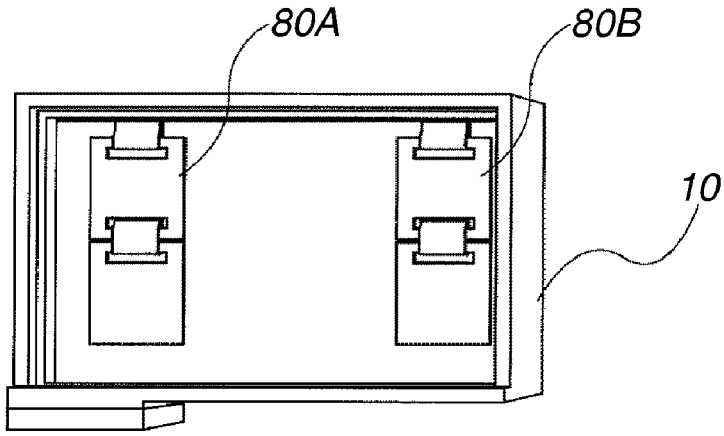

LIQUID CONTAINER

BACKGROUND OF THE INVENTION

1. Field of the Invention

The present invention relates to a liquid container (hereinafter referred to also as ink tank) for use in a recording apparatus which forms an image by discharging a recording agent such as ink. The present invention can be applied to a recording apparatus in general, and other apparatus such as a copying machine, a facsimile which has a communication system, a word processor which has a printing unit, or an industrial recording apparatus which is multiply combined with various processing apparatuses.

1. Description of the Related Art

An ink jet recording apparatus includes a recording head, an ink tank which is connected to the recording head and supplies ink to the recording head, and a carriage on which the recording head can be mounted. In order to record an image, ink droplets are discharged from a microscopic discharge port on the recording head in accordance with image data while the carriage is moved relative to the recording medium. These ink droplets are applied onto the recording medium to form the desired image.

Conventionally, in an ink jet recording apparatus as above described, ink containing dye (hereinafter referred to as dye ink) is mainly used as the color material. However, dye ink generally has problems in terms of light resistance and gas resistance, and there are cases where recorded images using dye ink cannot provide sufficient image robustness for outside display.

In order to deal with such problems, recording apparatuses which use ink containing pigment (hereinafter referred to as pigment ink) as the color material are already in the market. Pigments excel in light resistance and gas resistance, and recorded images using this type of ink show sufficient image robustness. However, as compared to the dye ink, the pigment ink has various problems in terms of handling. One example of such problems is the dispersibility of the color material within the ink.

Unlike the dye molecules, the pigment molecules do not dissolve into the ink solution, and the molecules float in a dispersed state. Therefore, when the ink tank is left at rest for some time, the pigment particles within the ink tank gradually settle out by gravitation, which causes a density inclination of the pigment particles heightwise in the ink tank. That is, at the bottom part of the ink tank, a layer is formed in which the density of the color material is high, and a low-concentration layer is formed at the upper part of the ink tank. If recording is started or continued in this state, a density difference appears between images outputted at an early stage and at a later stage of the usage of the ink tank.

More specifically, in an ink jet recording apparatus, the ink is supplied to the recording head from the bottom part of the ink tank. In this case, when an ink tank with a density inclination as above described is mounted on the apparatus, ink is supplied from the lower layer with a high density of color material at the start of the recording. As a result, an image with an excessively high density is outputted. As the number of recorded sheets of paper increases and the ink inside the ink tank is consumed, the density of the image gradually becomes lower. When the amount of ink in the ink tank becomes very little, only the ink with lower density of the color material as compared to the initial density is remaining. Therefore, the recorded object will show an insufficient density although it is recorded according to the same image data as at the beginning of the recording. In particular, there is a significant settling-out of the pigment particles in the case where the diameter or the specific gravity of the particle is large, and a density inclination large enough to have an effect on the image is generated only when the ink tank has not been used for several continuous days.

The above-described problem in that the density of the color material in the discharged ink fluctuates as the ink tank is being used, does not only generate a density difference between the images outputted at the beginning stage and the later stage of the color tank usage. A color ink jet recording system uses a plurality of color inks to express the desired hue based on a predetermined color balance. In the color ink jet recording system, the above problem can lead to the color imbalance, and becomes a more noticeable image issue.

To overcome the above problem, the density of the color material in the ink droplet discharged from the recording head is required to be maintained within a desired range independent of the amount of ink remaining in the ink tank. In order to realize this, it is desirable that the pigment molecules are dispersed evenly in the ink tank, at least during the recording.

In order to realize the even dispersion, an agitating member has been proposed which agitates the pigment molecules inside the ink tank (for examples, refer to Japanese Patent Application Laid-Open No. 2005-066520 and Japanese Patent Application Laid-Open No. 2004-216761.).

More specifically, Japanese Patent Application Laid-Open No. 2005-066520 discusses an ink pack (or tank) having an agitating member which can be operated manually according to the first and second exemplary embodiments. In this reference, the agitating member is inserted from the outside into the ink pack or the ink tank. The section of the agitating member which is externally protruding, acts as the operating section for moving the agitating section inside the ink pack (or tank). Both embodiments teach that the user oscillates the agitating section regularly or, as required, to directly agitate the ink inside the ink pack (or the ink tank) so that the pigment molecules can be dispersed.

The third exemplary embodiment of Japanese Patent Application Laid-Open No. 2005-066520 discusses an ink tank having an agitating member which agitates the ink inside the tank exerting the inertial force when the carriage moves in the recording process. As one example, an agitating member which is formed integrally with the ink tank case is discussed. The agitating member is extended hanging from the ceiling to the bottom part of the ink tank case, and a cylindrical spindle is formed at the bottom end of the agitating member. By the inertial force accompanying the acceleration, termination, and reverse movement of the carriage scanning, the agitating member oscillates in the scanning direction of the carriage with the base part fixed at the ceiling as the fulcrum and agitates the ink inside the tank.

Japanese Patent Application Laid-Open No. 2005-066520 discusses another example of an agitating member which is not fixed to the ink tank case and can move freely along the bottom surface of the ink tank. The agitating member moves along the bottom surface of the tank with an inertial force generated by the acceleration, termination, and reverse movement of the carriage scanning, and agitates the ink.

Furthermore, Japanese Patent Application Laid-Open No. 2004-216761 discusses an agitating mechanism having an axial spindle which oscillates from side to side centering the oscillation axis driven by the inertial force, and a plurality of fins formed together with the axial spindle which also oscillate from side to side, in accordance with the movement of the carriage. In this configuration, since the plurality of fins is arranged in parallel heightwise in the ink tank, the ink can be agitated evenly from the upper part to the lower part within the tank.

However, in order to constantly obtain a favorable dispersibility of the pigment particles, the agitation effect is not sufficient in both of the above references.

For example, in the first and second exemplary embodiments of Japanese Patent Application Laid-Open No. 2005-066520, since movement of the manually-operated agitating member is limited, only a limited area within the tank can be agitated. In particular, in the vicinity of the joining section between the agitating member and the ink tank which acts as the fulcrum, the area where the agitating member can move, is very narrow, and sufficient agitation cannot be achieved.

Besides, in the third exemplary embodiment of Japanese Patent Application Laid-Open No. 2005-066520, the area which can be agitated, is not sufficient although the inertial force is used efficiently. For example, in the case where the agitating member is formed integrally with the tank, the agitation in the vicinity of the fulcrum can be also insufficient. Furthermore, in the case of the agitating member that can move freely along the bottom surface of the ink tank, the upper part of the ink tank that is away from the agitating member, can not be expected to be well agitated as in the vicinity of the bottom part.

In contrast, a plurality of fins are arranged heightwise in the ink tank in the configuration discussed in Japanese Application Laid-Open No. 2004-216761 so that a heightwise uniform agitation can be expected to some extent. However, since the quantity of turning of the fins is small near the central shaft inside the tank, the agitation effect is small in that portion. Furthermore, the configuration of an agitation member having such plurality of fins or a rotating shaft is complex and the ink tank itself becomes expensive.

Originally, in an ink jet recording apparatus which mounts an ink tank on the carriage and records images, the width of the ink tank relative to the main scanning direction is designed to be narrow in order to avoid the apparatus from becoming large. Therefore, even in the case where an agitating member is provided inside the ink tank and the inertial force of the carriage movement is utilized, the amount of displacement in the main scanning direction is limited. Therefore, how to efficiently agitate all of the ink remaining inside the tank using the limited amount of displacement becomes the significant issue in the configuration of the agitating member. In the case where an image is recorded using an ink tank which has been laid at rest for a long time, an agitation such as the carriage oscillation must be performed before the recording. If this agitation is not performed efficiently, much time will be required for the warm-up process.

SUMMARY OF THE INVENTION

The present invention is directed to a liquid container which efficiently and evenly agitates the entire ink remaining inside the container even in the case where the container is used after a long period of non-use. Furthermore, the present invention is directed to providing a liquid container for containing pigment ink in which the agitation time can be minimized at the start of the recording operation.

According to an aspect of the present invention, a liquid container includes a containing portion adapted to contain a liquid, a supplying portion facilitating supplying the liquid from the containing portion to outside, and an agitating member configured to agitate the liquid, wherein the agitating member includes a bending portion which becomes bendable when the liquid container is displaced.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 8A, 8B, 8C, and 8D are cross-sectional views of the ink tank for describing the movement of the agitation member in the first exemplary embodiment.

FIG. 9 illustrates how the agitating member is set up in a modified example of the first exemplary embodiment.

DETAILED DESCRIPTION OF THE EMBODIMENTS

Embodiments of the invention will be described in detail below with reference to the drawings.

The ink jet recording apparatus on which the ink tank according to the present exemplary embodiment is mounted, is a non-impact recording apparatus which makes little noise when recording an image. In addition, since the apparatus can record onto various recording media at high speed, it is widely adopted as an apparatus serving as the recording mechanism in printers, word processors, facsimiles, and copying machines.

First Exemplary Embodiment

Figure 1:
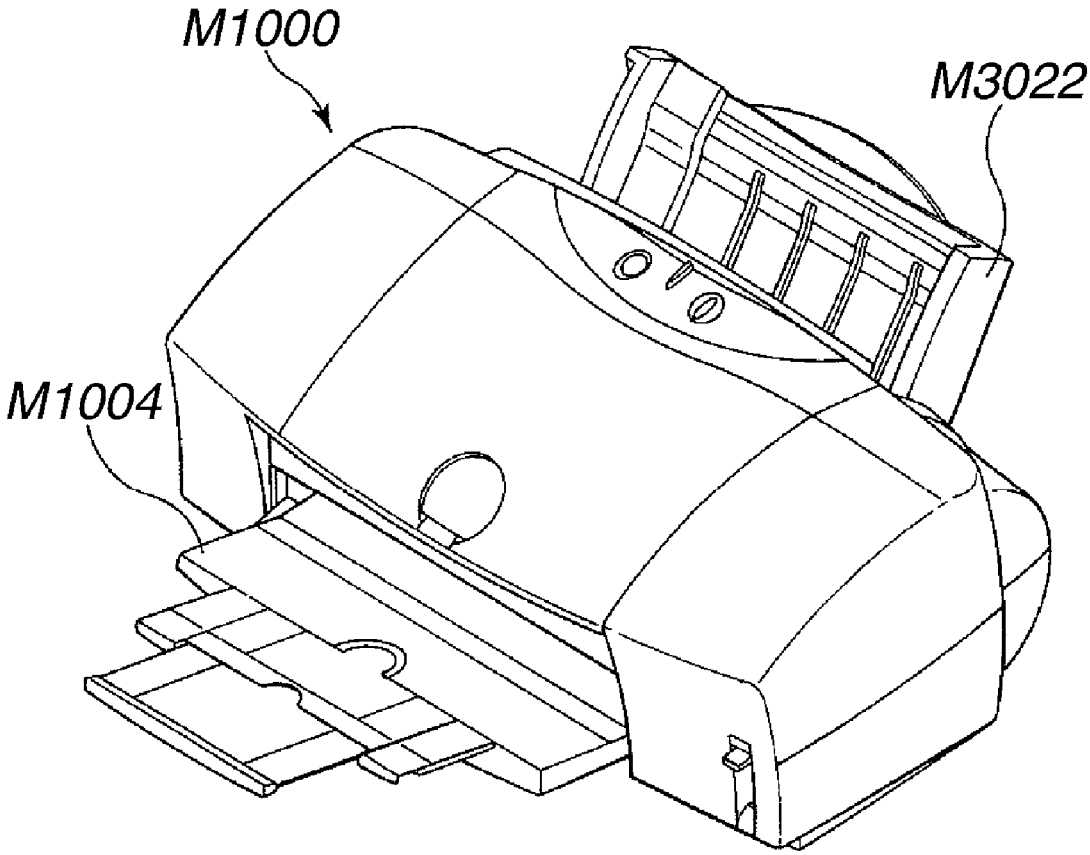
FIG. 1 is an external perspective view of the ink jet recording apparatus according to an exemplary embodiment in the present invention.

FIG. 1 is an external perspective view of the ink jet recording apparatus according to an embodiment of the present invention. The recording apparatus mainly includes the apparatus body M1000 which performs the recording onto a recording medium, a paper feed unit M3022 for supplying a recording medium to the apparatus, and a paper ejection tray M1004 which receives the recording medium after the recording is performed.

Figure 2:
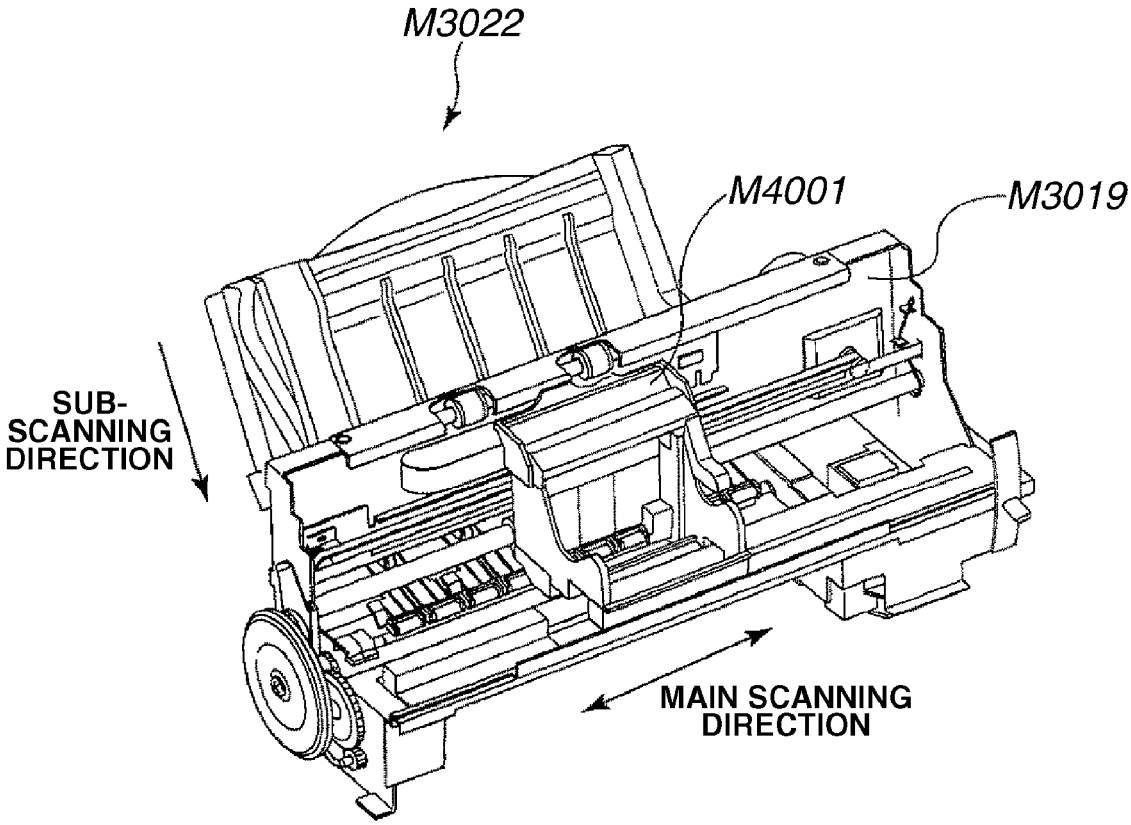
FIG. 2 is a diagram for describing the internal mechanism of the apparatus.

FIG. 2 is a diagram for describing the internal mechanism of the apparatus body M1000. The main internal mechanism of the apparatus body M1000 is arranged and protected within the chassis M3019. The carriage M4001 can move back and forth in the main-scanning direction as shown in FIG. 2 with a recording head cartridge (not shown) mounted on it. When an instruction to perform the recording operation is inputted, one sheet of the recording medium mounted on the paper feed unit M3022 is fed in the sub-scanning direction as in FIG. 2 and is conveyed to the position at which the recording can be performed by the recording head cartridge mounted on the carriage M4001. An image is formed sequentially on the recording medium repeating the main scan recording and conveying of the recording medium. In the main scan recording, the recording head discharges ink based on the image data as the carriage M4001 moves in the main scanning direction. Then, the recording medium is conveyed in the sub-scanning direction by a conveying unit.

Figure 3:
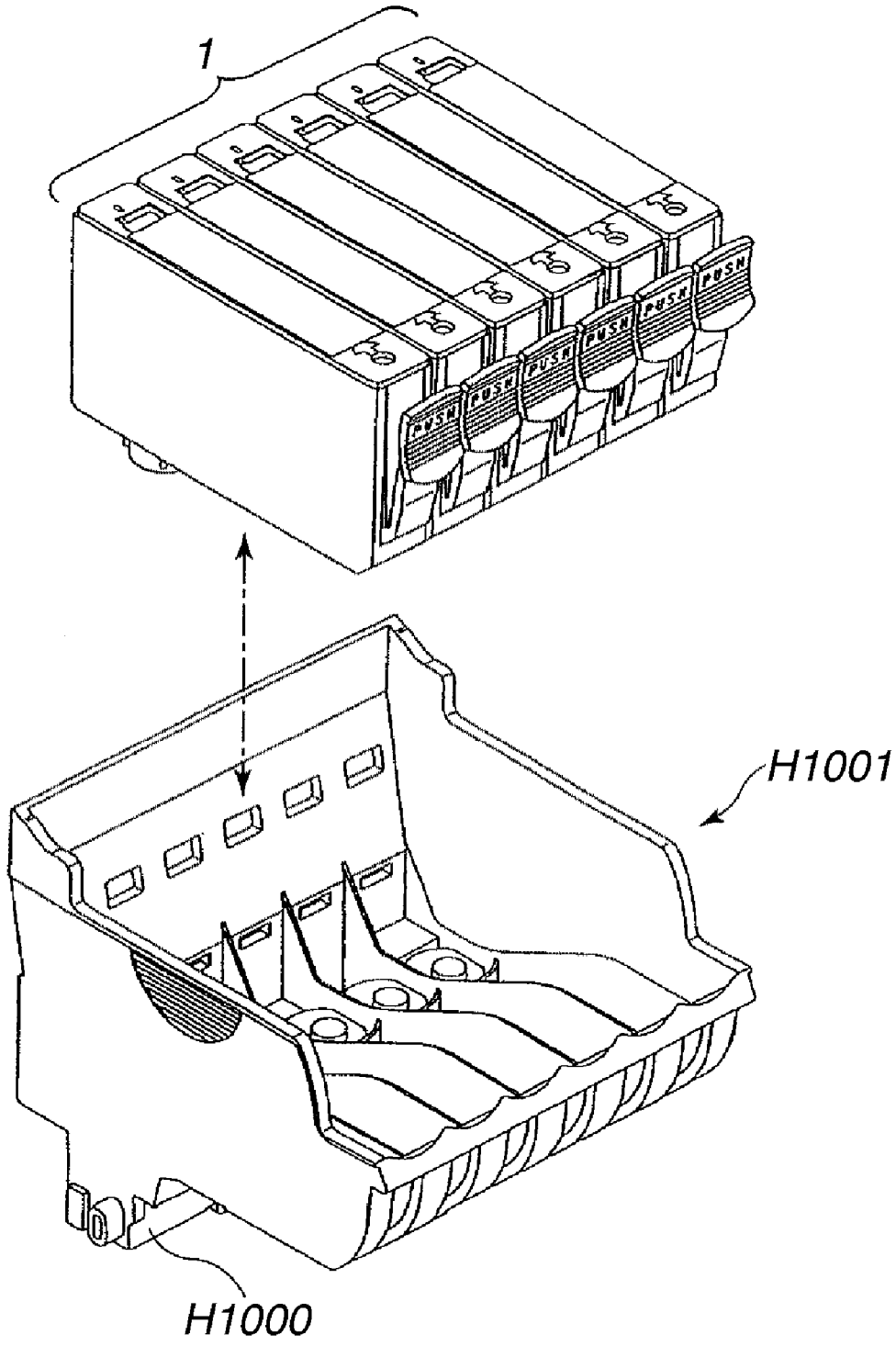
FIG. 3 illustrates how an ink tank is loaded onto the recording head cartridge according to an exemplary embodiment of the present invention.

FIG. 3 illustrates how an ink tank is loaded onto the recording head cartridge according to the present exemplary embodiment. The recording head cartridge H1001 has a recording head H1000 which can discharge ink as droplets, and a detachable ink tank 1 for supplying ink to the recording head H1000 can be loaded on the opposite side. In the present exemplary embodiment, the ink tank 1 contains six colors which can be loaded independently onto the recording head cartridge H1001.

A plurality of microscopic recording devices are arranged on the recording head H1000, and each recording device has a mechanism for discharging ink. For example, in a configuration in which electrothermal conversion devices having a heat element are disposed, a voltage pulse is applied to each of the electrothermal conversion devices in accordance with the discharge signal. As a result, the ink in the vicinity of the heat element is heated rapidly, and causes film boiling. As a result of the boiling, ink droplets are discharged from the discharging port.

(Configuration of Ink Tank)

Figure 4:
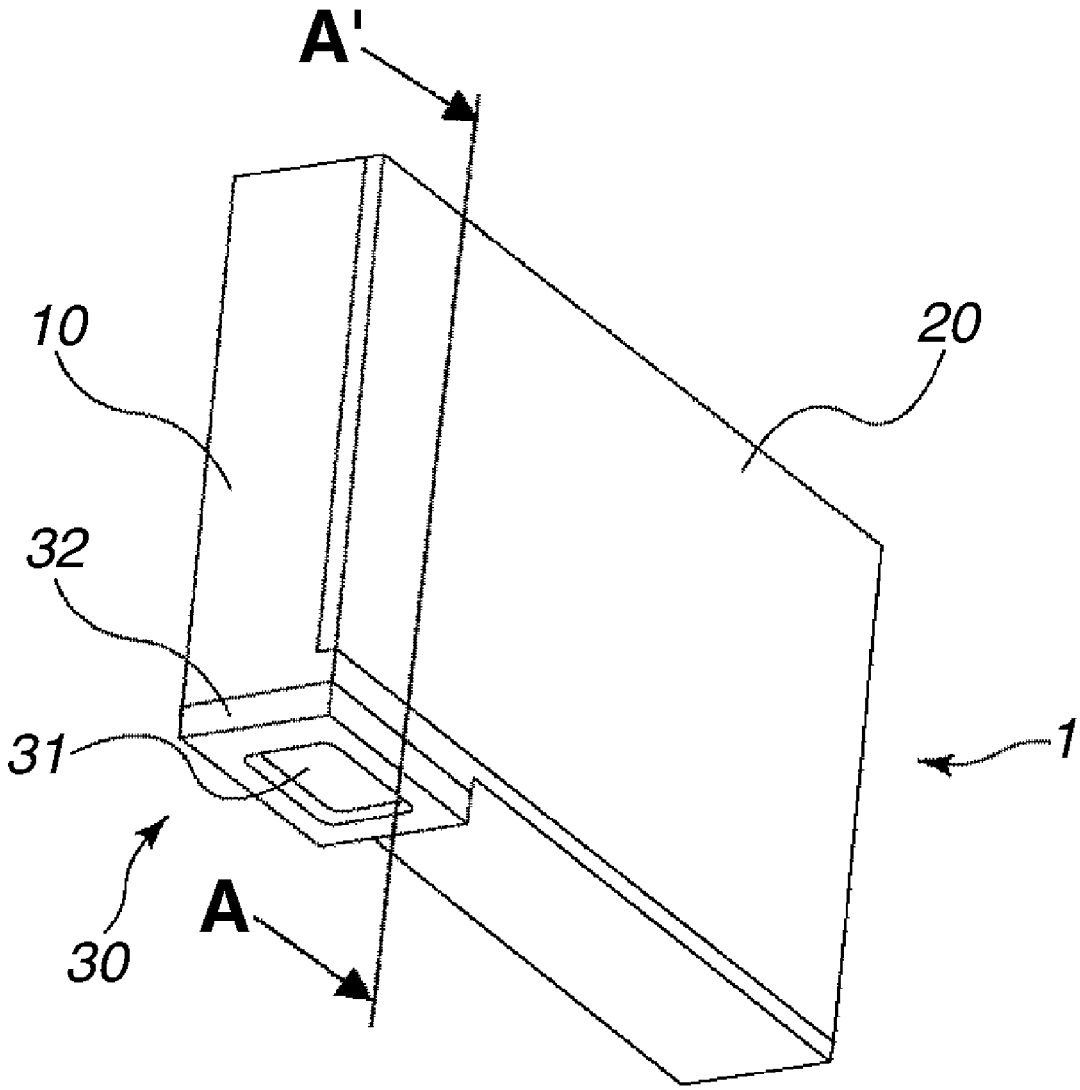
FIG. 4 is an external view of the ink tank according to an exemplary embodiment in the present invention.

FIG. 4 is the external view of the ink tank 1 according to the present exemplary embodiment. The ink tank 1 is a container which has an ink containing chamber inside, and its exterior is configured of a container main body 10 and a covering member 20. At the bottom part of the ink tank 1, an ink supplying port 30 is disposed for supplying ink to the recording head.

Figure 5:
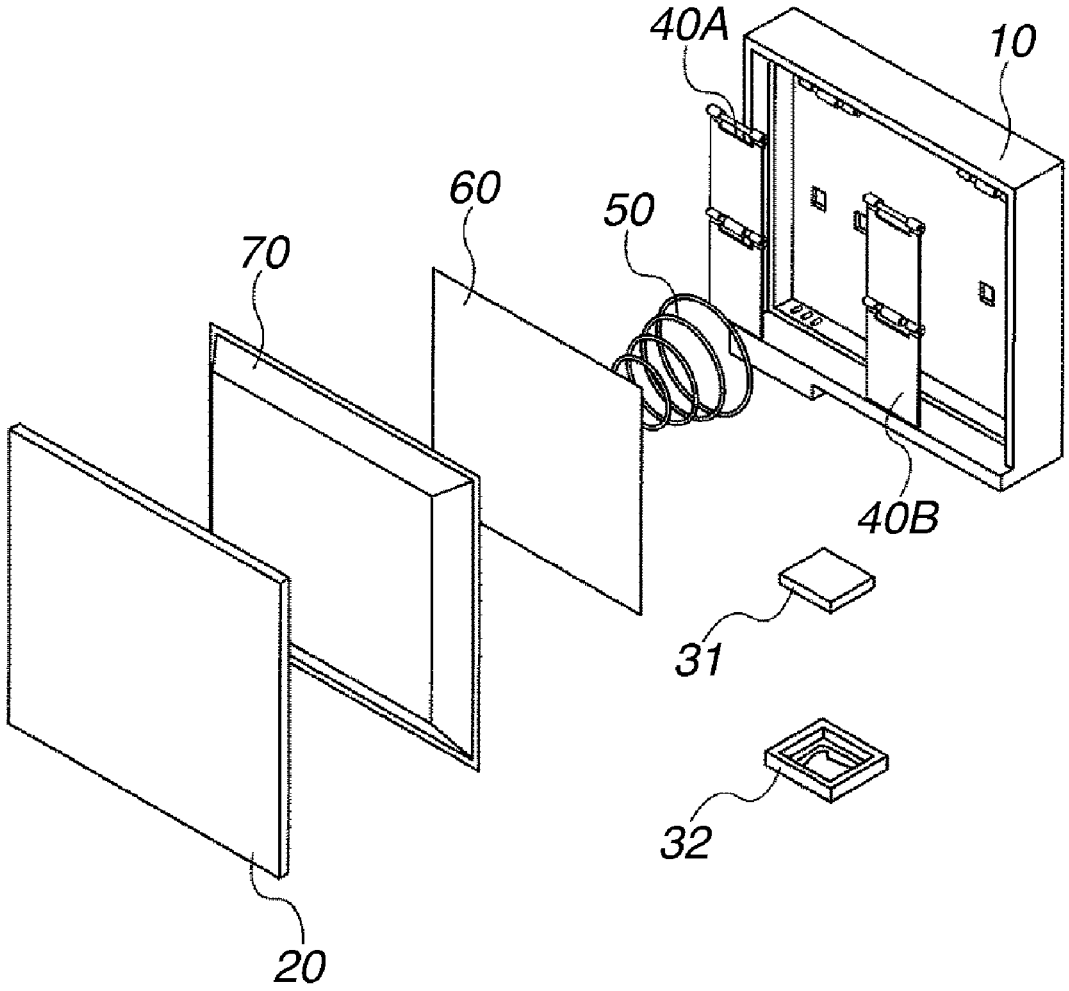
FIG. 5 is an exploded view of the ink tank according to an exemplary embodiment in the present invention.

FIG. 5 is an exploded view of the ink tank 1. The container main body 10 of the ink tank 1 is formed of material such as polypropylene. Inside the ink tank, agitating members 40A and 40B for agitating the ink, a spring member 50, a plate 60, and a flexible film 70 are arranged as shown in FIG. 5. The ink tank 1 is sealed by the covering member 20. The plate 60 and the flexible film 70 that constitute the liquid containing member are both displaced in the direction that the inner volume of the ink containing chamber 13 (FIG. 8A) decreases as the ink is consumed. A meniscus forming member 31 is provided at the bottom part of the ink tank 1 where the ink supplying port 30 is formed. The meniscus forming member 31 can be a capillary tube that is made of a material such as polypropylene fiber and has capillary force, or an absorber formed by combining the above capillary tube with a filtering member (transmission dimension about 15 to 30 μm, made of material such as stainless material or polypropylene). The meniscus forming member 31 communicates with the interior of the container main body 10 through an ink channel, and the ink can be supplied from the ink containing chamber 13 within the container main body 10 to the recording head. On the other hand, a meniscus of ink is formed within the meniscus forming member 31 to keep air bubbles from entering the container main body 10 from the outside. The meniscus forming member 31 is held down from the outside by a holding member 32. The flexible film 70 is welded onto the peripheral of the orifice of the container main body 10 to form an ink containing chamber 13 inside the container main body 10. That is, the ink is contained in the ink containing chamber 13 formed by the flexible film 70 and the container main body 10. The flexible film 70 can be a film having a thickness of about 20 to 100 μm, such as polypropylene film.

The spring member 50 exerts a force that expands the flexible film 70 outward through the plate 60. By the exertion of the spring force, negative pressure is generated in the ink containing chamber 13. On the contrary, there is a communicating channel (not shown) with the atmosphere in the covering member 20, and the exterior of the ink containing chamber 13 is maintained at atmospheric pressure. The spring member 50 and the plate 60 can be formed of a stainless material.

As the ink inside the ink containing chamber 13 is supplied to the recording head and consumed, the spring member 50 is compressed, the flexible film 70 bends, and the volume of the ink containing chamber 13 decreases. The ink tank in the present exemplary embodiment can consume the ink inside the ink containing chamber 13 until the plate 60 contacts the inner wall of the container main body 10.

(Configuration of Agitating Mechanism)

Figure 6:
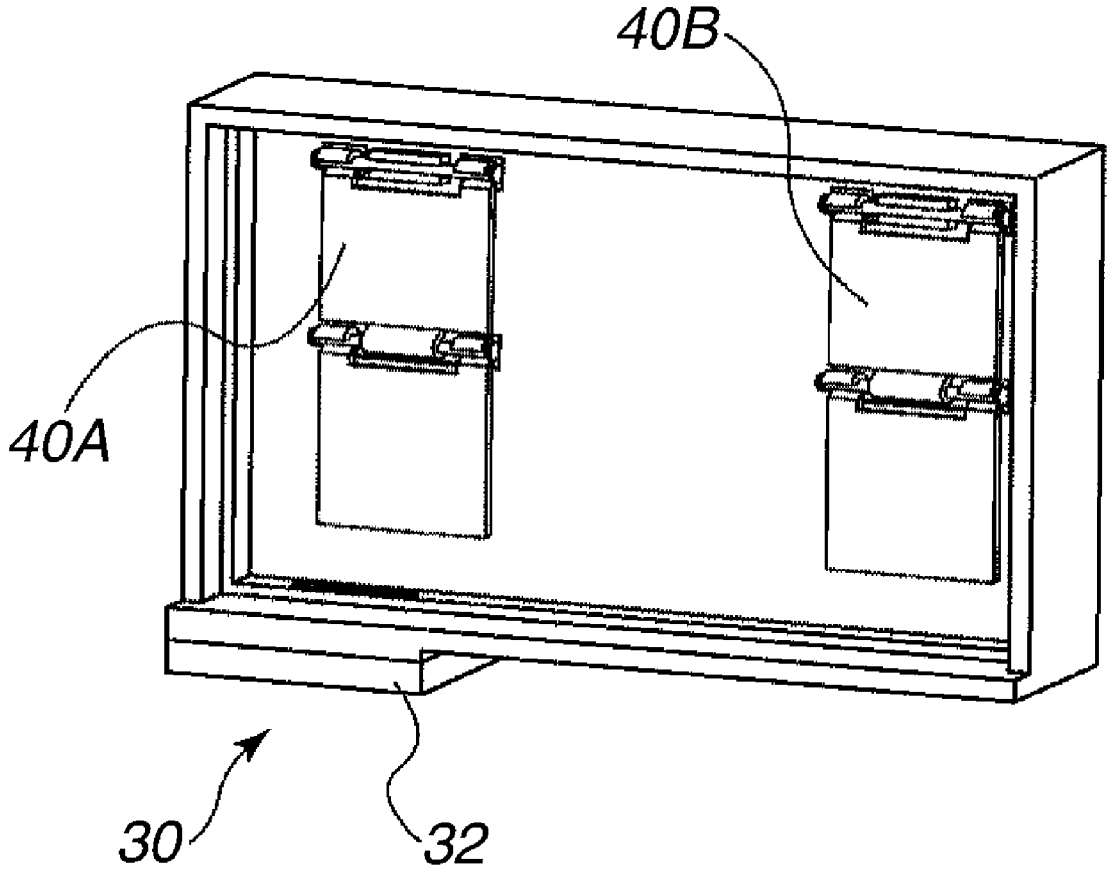
FIG. 6 illustrates how the agitating member is set up in the first exemplary embodiment.

FIG. 6 illustrates how the agitating members 40A and 40B are arranged. The agitating members 40A and 40B are disposed on both sides of the spring member 50 on the inner wall of the containing main body 10 so as to not contact the spring member 50. The agitating member is a plate which has a greater specific gravity compared to ink and has such weight as it can move inside the ink with the inertial force exerted by the movement of the ink tank.

Figure 7A:
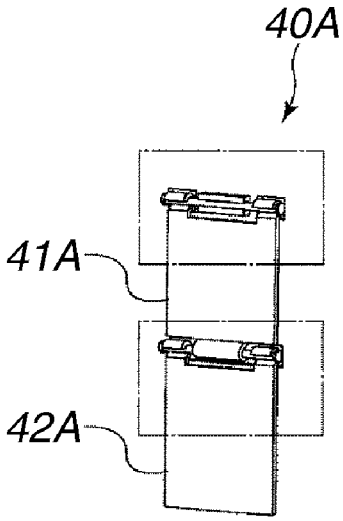
FIGS. 7A, 7B, and 7C are enlarged schematic views for describing the configuration of the agitation member.
Figure 7B:
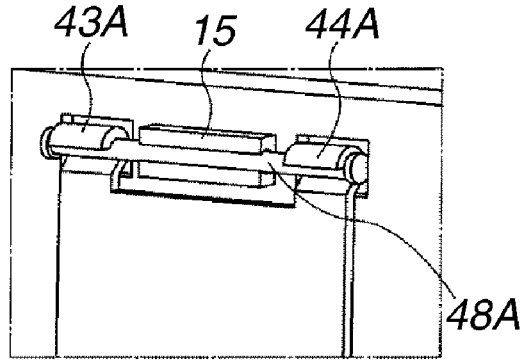
Figure 7C:
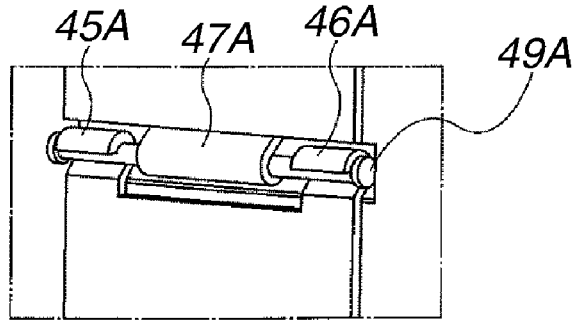

FIGS. 7A, 7B, and 7C are enlarged schematic views for describing the configuration of one of the agitating members 40A. In FIG. 7A, the agitating member 40A has two agitating plates 41A and 42A that are connected heightwise. The agitating plates 41A and 42A can be formed of a stainless material. However, the material is not limited to stainless material, and any material which has a greater specific gravity compared to the ink contained in the container main body 10 can be used.

FIG. 7C is an enlarged view of the connecting section of the two agitating plates 41A and 42B. A connecting shaft 49A is provided in the connecting section, and the agitating plate 41A on the upper side is rotatably fixed onto the connecting shaft 49A by a hook 47A below it. The agitating plate 42A on the lower side is also rotatably fixed to the connecting shaft 49A by the hooks 45A and 46A above it. As a result, the two agitating plates 41A and 42A can be displaced in a folding manner while the shaft 49A serves as the fulcrum. There are steps at both ends of the connecting shaft 49A. The diameters of the steps are larger than the diameters of the hooks 45A and 46A where the ends of the connecting shaft 49A contact with the hooks. Thus, the agitating plates 41A and 42A do not move off to the side or drop off. However, the means to prevent the agitating plates from moving off to the side and dropping-off is not limited to this, and, for example, a different member such as an E pin can be instead placed on both ends of the connecting shaft.

FIG. 7B is an enlarged view describing how the upperside agitating plate 41A is disposed on the inner wall of the container main body 10. The agitating plate 41A is rotatably fixed to the connecting shaft 48A by the hooks 43A and 44A arranged above it. The connecting shaft 48A is lightly plugged into the hook 15 on the inner wall of the container main body 10.

Thus, the agitating member 40A is configured of two agitating plates 41A and 42A that can bend to each other. The agitating member 40A turns around the connecting shafts 49A and 48A which are fixed on the inner wall of the container main body 10 and serve as the axis, and agitates the ink inside the ink containing chamber 13. While only one of the agitating members 40A has been described here, the other agitating member 40B has the same configuration. In the present exemplary embodiment, the agitating members 40A and 40B are placed in an approximately symmetrical position on both sides of the spring member 50 on the inner wall of the container main body 10.

(Movement and Effect of Agitating Mechanism)

FIGS. 8A, 8B, 8C, and 8D are sectional side views of the ink tank 1 for describing the movement of the agitating member in the present exemplary embodiment and are cross-sections of the external view shown in FIG. 4 along the line A-A'. FIG. 8A shows the first state of the agitating member 40A. The first state is a state in which the carriage M4001 is moving at a constant speed in the direction of the arrow C1 or C2, or is stationary. At this stage, inertial force is not exerted on the ink tank 1. Therefore, the agitating member 40A is hanging along the inner wall of the container main body 10.

FIG. 8B shows the second state of the agitating member 40A. Since the carriage M4001 moves back and forth within the range of the printing width of the recording medium, the carriage M4001 decelerates, stops, and accelerates in the opposite direction when changing the direction of movement. At this stage, the inertial force is exerted on the ink tank 1. In the case where the inertial force is exerted in the direction of the arrow C2, that is, where the carriage changes direction from the direction of the arrow C2 to C1, the agitating member 40A sticks on the inner wall of the container main body 10, namely, is in a same state as in FIG. 8A. On the other hand, in the case where the inertial force is exerted in the direction of the arrow C1, that is, where the carriage changes directions from the direction of the arrow C1 to C2, the agitating member 40A is displaced within the ink containing chamber 13 while the connecting shaft 48A serves as the fixed fulcrum. Consequently, the free end of the agitating member 40A contacts the plate 60A within the ink containing chamber 13. The state in which the inertial force is exerted in the direction of the arrow C1 as described above, is referred to as a second state. If the agitating member does not have any bending fulcrum (bending portion) other than the fulcrum (48A) fixed to the container main body 10 as in the above described references, the amount of displacement of the agitating member becomes the largest in the second state, and the area indicated with the hatching in FIG. 8B is the displacement area of the agitating member.

FIG. 8C shows a third state of the agitating member 40A. In the second state, the agitating member 40A contacts the plate 60, and in the case where the inertial force is maintained further, the agitating member 40A bends at the connecting shaft 49A that acts as the bending fulcrum (bending portion), and moves inside the ink containing chamber 13 as shown in the figure. The agitating member 40A moves until the bending portion contacts with the connecting shaft 49A acting as the fulcrum contacts the plate 60. In that state, the maximum displacement is achieved. The displacement area from the second state to the third state is shown by the hatching in FIG. 8C.

As the carriage M4001 which has been scanning in the direction of the arrow C2, decelerates, stops, and accelerates in the direction of the arrow C1, the agitating member is pressed against the inner wall of the container main body 10 and returns to the first state. Since the back and forth movement of the carriage M4001 is repeated along with the recording operation, the agitating member 40A repeats the first state-second state-third state cycle and can agitate the ink inside the ink containing chamber 13.

The feature of the agitating member 40A in the present exemplary embodiment is that the displacement area inside the ink containing chamber is enlarged compared to the prior art by providing the bending portion (49A) other than the fixed fulcrum (48A) placed on the container main body 10. That is, the displacement area from the second state to the third state as shown by the hatching in FIG. 8C is an enlarged portion compared to the conventional, enabling efficient agitation inside the ink containing chamber. In particular, an ink flow as shown by the arrow in FIG. 8C is generated when the agitating plate 41A turns at the time of the transition from the second state to the third state. As a result, the pigment particles that are prone to settling out on the bottom are raised to the upper layer of the ink containing chamber 13, and the inside of the ink containing chamber 13 can be evenly agitated.

FIG. 8D shows a fourth state in which the ink in the ink tank of the present exemplary embodiment has been consumed to some extent. Since the atmosphere does not enter the ink containing member 13 in the configuration of the ink tank according to the present embodiment, the flexible film 70 moves toward the container main body 10 (to the left side of the figure) together with the plate 60 by an amount equal to the ink consumed, and the volume of the ink containing chamber 13 gradually decreases. That is, the ink contained in the ink containing chamber 13 not only decreases downward by gravity but also decreases in the direction to the side wall. Under such condition, when an inertial force in the direction of the arrow C1 is exerted on the agitating member 40A, the agitating member 40A contacts the plate 60 earlier as compared to the state in which the ink tank is filled up with ink. However, since the agitating member can move further around the connecting shaft 49A acting as the bending fulcrum, the ink can be efficiently agitated inside the ink containing chamber 13 even in a direction that the agitating member 40A can only narrowly move As described above, according to the present exemplary embodiment, by providing a plurality of bending points (bending portions) on the agitating member which turns by inertial force, the displacement can further continue around other bending point (bending portion) even when a part of the agitating member contacts the inner wall of the ink containing chamber or the arranged components. As a result, the agitating area within the ink containing chamber is enlarged, and efficient and uniform agitation of the entire ink containing chamber can be performed without being affected by the inner volume of the ink containing chamber.

(Modified Example of Configuration of Agitating Mechanism)

In the above exemplary embodiment, the two agitating plates are connected by a hook and a connecting shaft. However, the configuration in which the effect of the present exemplary embodiment can be achieved is not limited to the above exemplary embodiment.

FIG. 9 illustrates an arrangement of agitating members 80A and 80B as a modified example of the present exemplary embodiment. The constituent elements that are the same as the above exemplary embodiments are allocated the same reference numerals, and explanation on these elements is not repeated. In the modified example, the agitating member 80A and 80B are disposed on the inner wall of the container main body 10 and on both sides of the spring member 50 as in the above exemplary embodiment.

Figure 10:
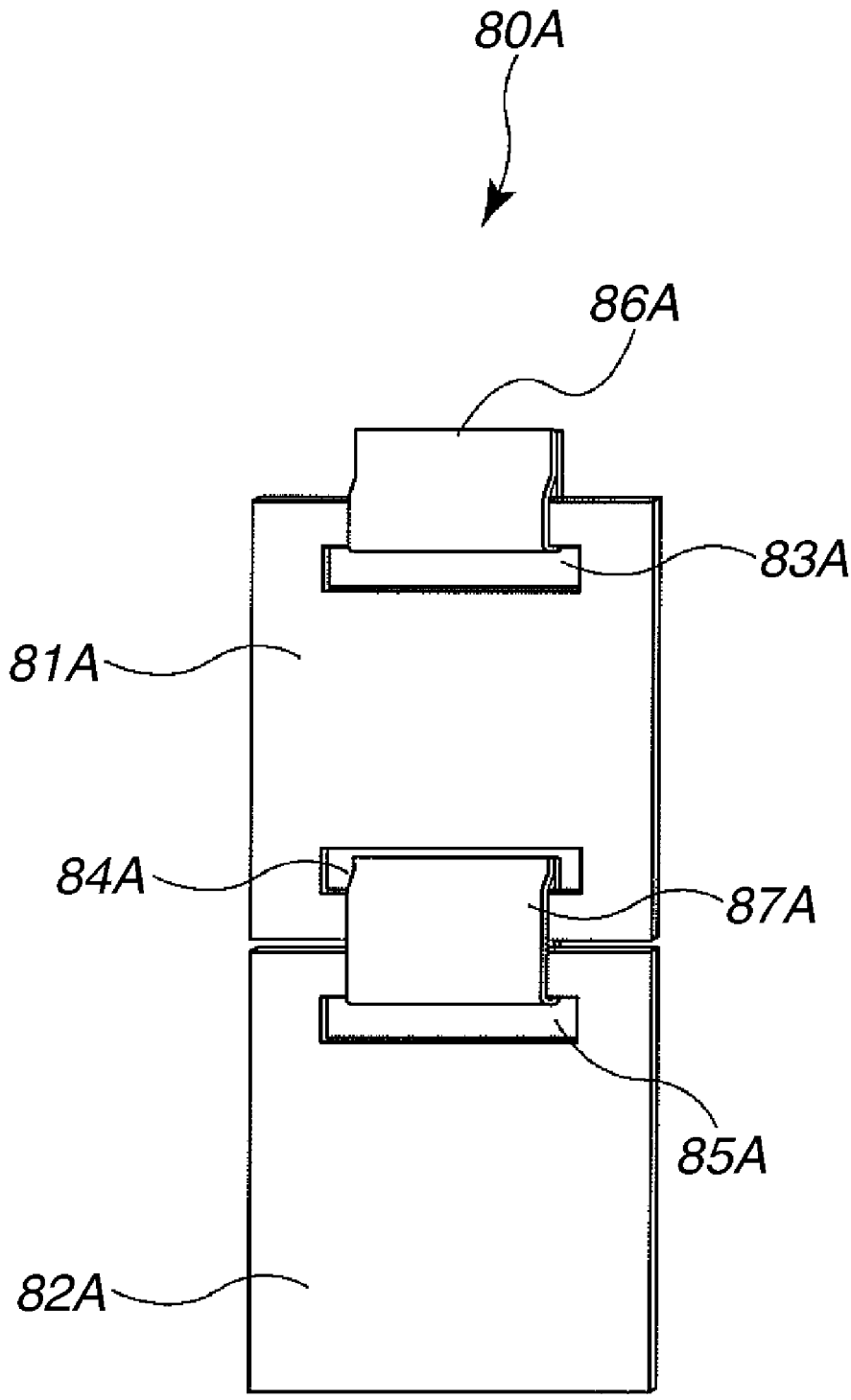
FIG. 10 is an enlarged schematic view for describing the configuration of the agitating member in a modified example of the first exemplary embodiment.

FIG. 10 is an enlarged schematic view for describing the configuration of the agitating member 80A. Similar to the above exemplary embodiment, the agitating member 80A has two agitating plates 81A and 82A connected heightwise. Below the agitating plate 81A positioned on the upper side, and above the agitating plate 82A positioned on the lower side are orifices 84A and 85A respectively. A plastic sheet 87A is passed through the orifices 84A and 85A and welded together in a ring shape. Therefore, the agitating plates 81A and 82A are arranged so as to be able to turn in respect of each other by way of the plastic sheet 87A.

Figure 11A:
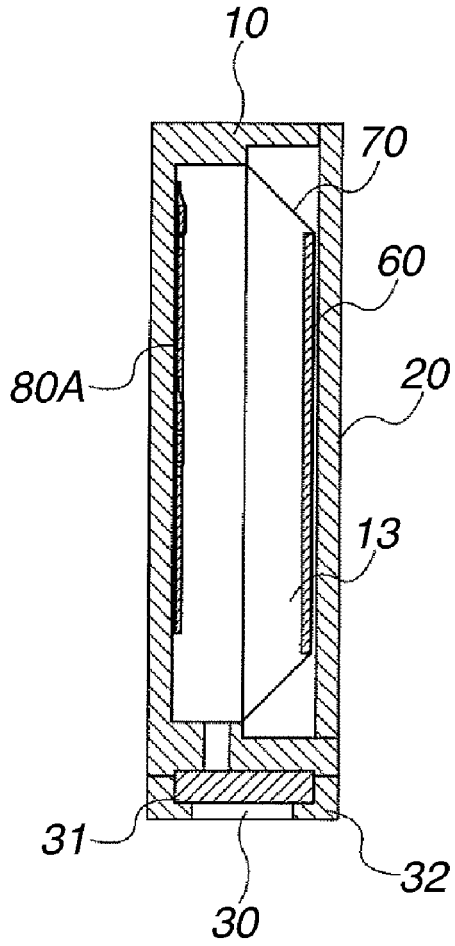
FIGS. 11A, 11B, and 11C are sectional side views for describing how the two agitating plates are joined in the modified example.
Figure 11B:
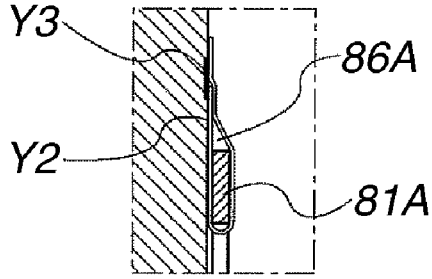
Figure 11C:
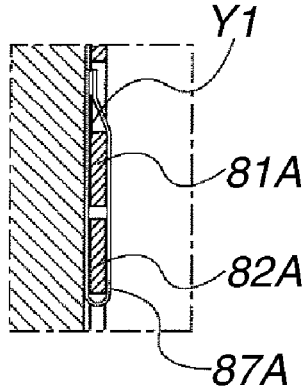

FIGS. 11A, 11B, and 11C are side-sectional views for describing how the agitating plates 81A and 82A in the modified example are connected. FIG. 11C is an enlarged view of the connection by the plastic sheet 87A. The plastic sheet 87A is welded and joined in a ring shape, and connects the two agitating plates 81A and 82A. A monolayer polypropylene (PP) sheet of thickness 20-200 μm can be used for the plastic sheet 87A. However, the sheet 87A is not limited to the above polypropylene. Other materials that will not be transformed by a reaction with ink can also be used. The plastic sheet 87A has flexibility and can be deformed with the movement of the agitating plates 81A and 82A. In the above configuration, the two agitating plates 81A and 82A can bend with respect to each other at the connecting section formed by the plastic sheet 87A.

Furthermore, there is an orifice 83A above the agitating plate 81A, and a plastic sheet 86A made of the same material as the plastic sheet 87A is passed through the orifice. FIG. 11B is an enlarged view of the connection made by the plastic sheet 86A. The plastic sheet 86A is welded and joined at Y2 on the reverse side, and welded and fixed on the inner wall of the container main body 10 at Y3. The plastic sheet 86A has flexibility similar to the plastic sheet 87A, and the agitating member 80A can turn around the point Y3 that is welded fixed on the inner wall of the container main body 10, as the fulcrum.

As described above, the connecting mechanism between the agitating plates, and the connecting mechanism between the agitating member and the container main body can also bend with respect to each other in the modified example. A configuration which satisfies this condition can realize the effect of the present exemplary embodiment already described. It should be noted that the material and configuration for the connecting section such that the reaction force in the turning and the bending, or the resistance component can be minimized as much as possible.

Second Exemplary Embodiment

(Configuration of Agitating Mechanism)

The second exemplary embodiment is described below. The second exemplary embodiment also uses an ink tank that can be mounted on the recording apparatus as described in FIG. 1 to FIG. 3, and the configuration of the ink tank, excluding the agitating member, is the same as the first exemplary embodiment. Therefore, the constituent elements that are the same as in the first exemplary embodiment are allocated the same reference numeral, and explanation on these is not repeated.

Figure 12:
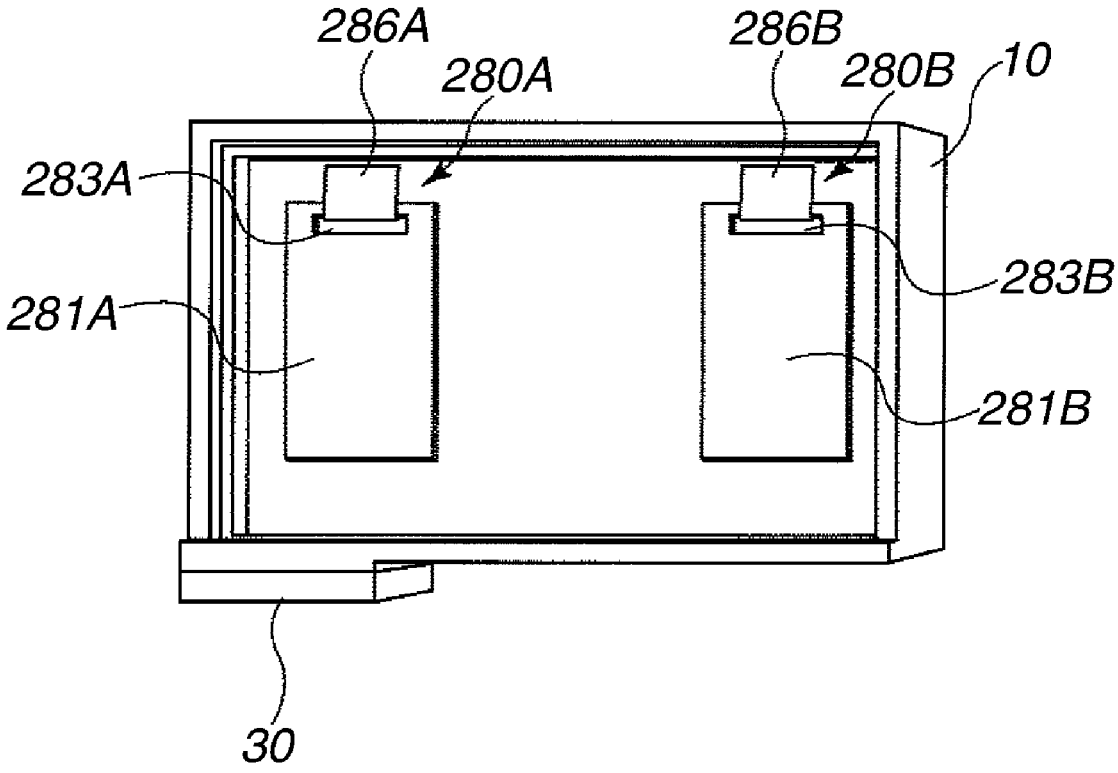
FIG. 12 illustrates how the agitating member is set up in the second exemplary embodiment.

FIG. 12 illustrates how agitating members 280A and 280B are disposed in the present exemplary embodiment. As in the first exemplary embodiment, the two agitating members 280A and 280B are arranged on both sides of the spring member 50 on the inner wall of the container main body 10 so as to not contact the spring member 50. Since the configurations of the agitating member 280A and 280B are the same, the agitating member 280A is described below in detail.

The agitating member 280A is configured of an agitating plate 281A and a plastic sheet 286A connected to the plate. The agitating plate 281A and the plastic sheet 286A can be of the same material as in the first exemplary embodiment but is not limited to that material. There is an orifice 283A above the agitating plate 281A, and the plastic sheet 286A is passed through the orifice 283A and weld-fixed onto the inner wall of the container main body 10 at a position Y22 (FIG. 13B) as in the first exemplary embodiment. However, in the second exemplary embodiment, the plastic sheet 286A is designed to be long so that the distance between the agitating plate 281A and the welding point Y22 is longer than that in the first exemplary embodiment, and the plastic sheet 286A itself plays the same role as the agitating plate.

(Movement and Effect of Agitating Mechanism)

Figures 13A, 13B, 13C:
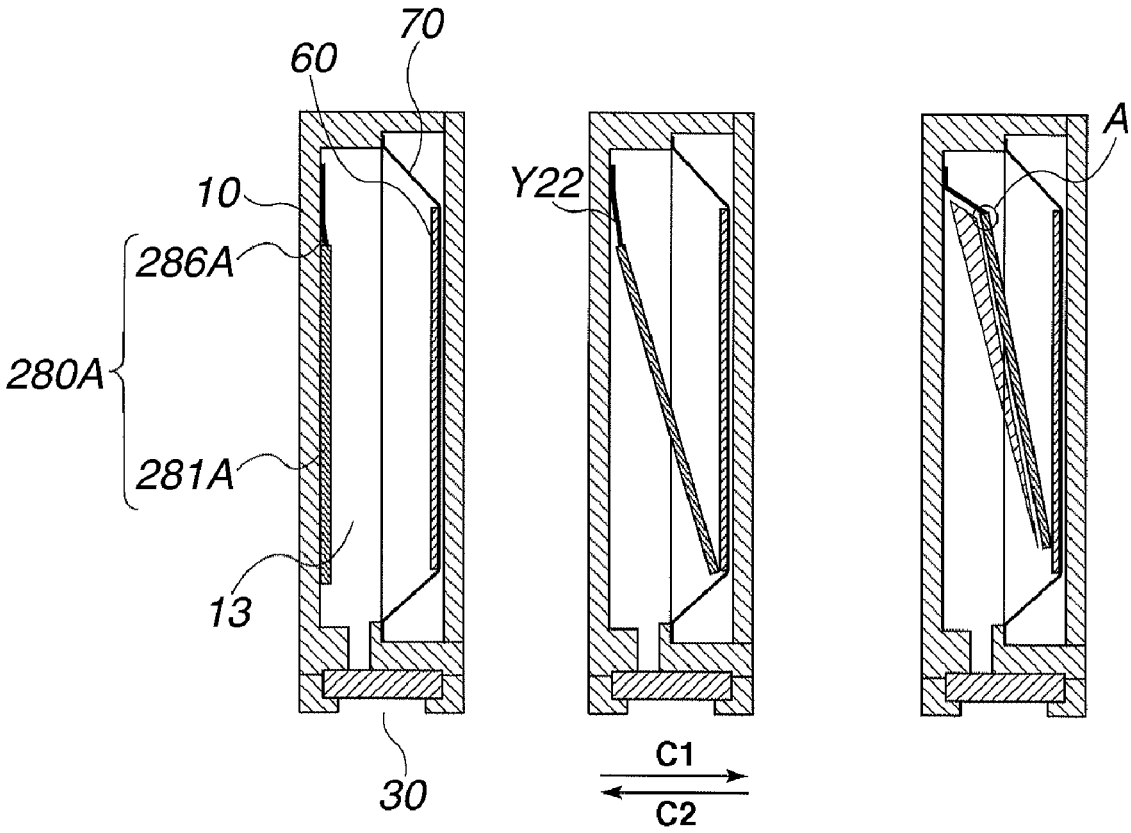
FIGS. 13A, 13B, and 13C are cross-sectional views of the ink tank for describing the movement of the agitating member in the second exemplary embodiment.

FIGS. 13A, 13B, and 13C are cross-sectional views of the ink tank 1 for describing the movement of the agitating member in the present exemplary embodiment. FIG. 13A shows the first state of the agitating member 280A which is the same as in the first exemplary embodiment. In the case where an inertial force is not exerted on the agitating member 280A, or in the case where an inertial force is exerted on the direction of the arrow C2, the agitating member 280A is kept close to the inner wall of the container main body 10.

FIG. 13B shows the second state of the agitating member 280A. As the carriage M4001 which was scanning in the direction of the arrow C1, decelerates, stops, and accelerates in the direction of the arrow C2, an inertial force is exerted on the ink tank 1. The agitating member 280A turns around the main fulcrum (i.e., the weld-fixed section Y22), and the free end of the agitating member 280A contacts the plate 60 inside the ink containing chamber 13.

FIG. 13C shows the third state of the agitating member 280A. The agitating member 280A contacts the plate 60 in the second state, and in the case where the inertial force is maintained further, there is bending at the connecting section A between the agitating plate 281A and the plastic sheet 286A so that the agitating member 280A moves further within the ink containing chamber 13. As described, the feature of the agitating member 280A in the present exemplary embodiment is that the container main body 10 and the agitating plate 281A are joined by a plastic sheet 286A which is flexible and is of a certain length. In such configuration, the displacement area from the second state to the third state as shown by the hatching in FIG. 13C is an enlarged portion as compared to the conventional, and the interior of the ink containing chamber 13 can be efficiently and evenly agitated. As in the previously described exemplary embodiment, there is a force which acts to agitate in the upper direction of the ink containing chamber 13 in the present exemplary embodiment. Accordingly, the pigment particles that are likely to settle out at the bottom are lifted to the upper layer of the ink containing chamber 13, and the interior of the ink containing chamber 13 can be agitated.

As the carriage M4001 which has been scanning in the direction of the arrow C2, decelerates, stops, and accelerates in the direction of the arrow C1, the agitating member 280A is pressed against the inner wall of the container main body 10 and returns to the first state. Since the carriage M4001 continues to repeat the back and forth movement along with the recording operation, the agitating member 280A repeats the first state-second state-third state cycle as shown in FIGS. 13A, 13B, and 13C and agitates the ink inside the ink containing chamber 13.

Figure 14A:
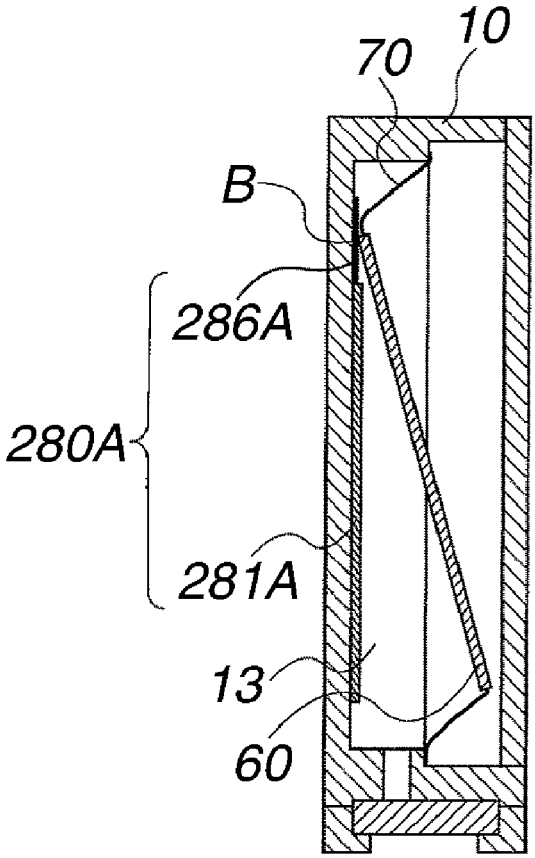
FIGS. 14A and 14 B illustrate the state in which the ink has been consumed to some extent in the ink tank in the second exemplary embodiment.
Figure 14B:
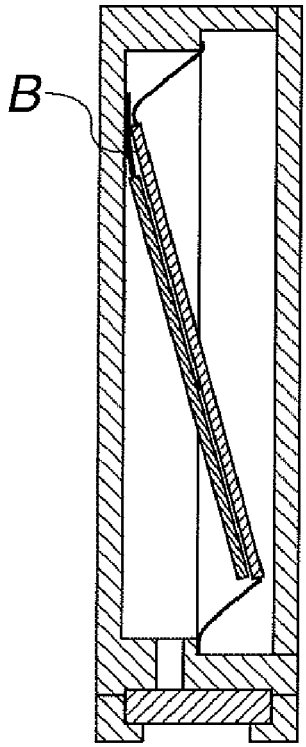

FIGS. 14A and 14B show the first state and the second state in the ink tank described in the second exemplary embodiment in which the ink has been consumed to some extent. As the ink is consumed, the plate 60 is affected by the water head of the ink that the plate 60 may gradually move closer to the agitating member 280A in a slanted state as shown in FIG. 14A. As a result, for example, the plate 60 contacts the plastic sheet 286A of the agitating member 280A at point B shown in FIG. 14A. That is, the agitating member 280A is pressed against the inner wall by the plate 60. In the case where the agitating member is configured of a single member, the fulcrum section of the agitating member is pressed by the plate 60, and, in some case, the agitating member can not make movement.

However, even in such a state, since the vicinity of point B is configured of a flexible plastic sheet 286A, the agitating plate 281A can turn around the point B acting as the fulcrum. That is, as in FIG. 14B, the agitating member 280A in the second state turns around the point B acting as the turning fulcrum by the inertial force, and the ink inside the ink containing chamber 13 in which the volume has decreased can be efficiently agitated.

The slanted state of the plate 60 is affected by a certain amount of rigidity of the flexible film 70, and the contact position of the agitating member 286A changes accordingly. However, since the plastic sheet 286A in the second exemplary embodiment is configured to be comparatively long, the range within which the plastic sheet 286A can contact the plate 60 that can be the turning fulcrum, is also wide. Therefore, however the slanting state of the plate 60 may be, the interior of the ink containing chamber 13 can be well agitated.

According to the present exemplary embodiment, since a part of the agitating member which moves by the inertial force is made of a flexible plastic sheet, the displacement centering around the bending point on the plastic sheet can be continued even in the state where a part of the agitating member contacts or is fixed to the inner wall inside the ink containing chamber or other arranged component. As a result, the agitation area inside the ink containing chamber is enlarged, and the agitation of the entire ink containing chamber can be efficiently and evenly conducted.

Other Exemplary Embodiments

In the above exemplary embodiment, the agitating member fixed on one side within the ink tank can efficiently agitate the ink inside the ink containing chamber even when the ink volume decreases. However, the present invention is not limited to this configuration. The feature of the present invention is to agitate the ink inside the ink tank as efficiently and evenly as possible by providing an agitating member having more than two bending portions inside the tank while the agitating member is changed into various shapes with the bending portion acting as the fulcrum. Therefore, the position on which the agitating member is fixed inside the tank, the number of bending portions, and the configuration of the ink tank other than the agitating member are not limited to the above two exemplary embodiments.

Figure 15A:
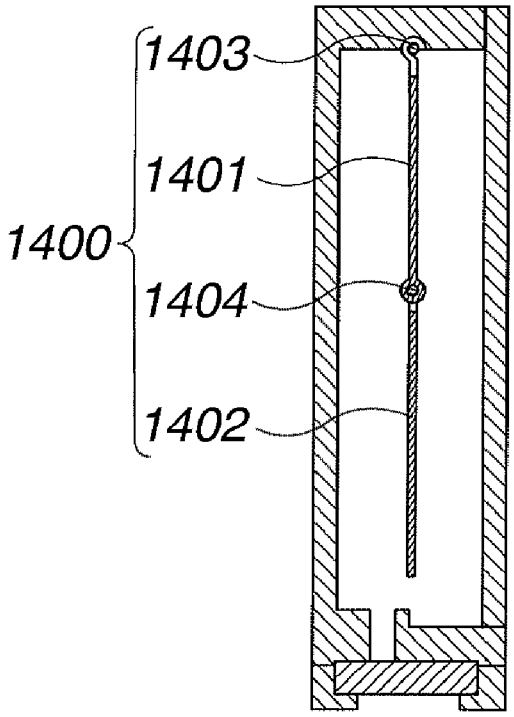
FIGS. 15A and 15B are cross-sectional views for describing another example of an ink tank according to an exemplary embodiment of the present invention.
Figure 15B:
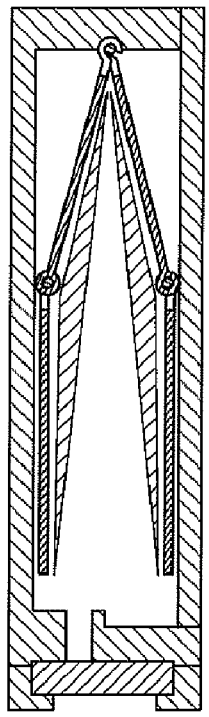

FIGS. 15A and 15B are cross-sectional views for describing another example of an ink tank that is applicable to the present invention. In FIG. 15A, the agitating plates 1401 and 1402 are made of the same materials as in the above exemplary embodiment. The connecting shafts 1403 and 1404 are made of the same material as in the first exemplary embodiment. The agitating plates and connecting shafts are connected in the same manner as in the first exemplary embodiment. However, in the present example, there is a hook for the inner wall at the ceiling of the ink tank, and two agitating plates 1401 and 1402 are arranged hanging from approximately the center of the ink tank width. When the recording operation is not conducted, the agitating member 1400 is in a stationary state as shown in FIG. 15A. As the carriage starts the back and forth movement and an inertial force is exerted, the agitating member 1400 oscillates from side to side as shown in FIG. 15B.

In the case where the agitating plate is configured of one plate, the turning stops when the edge of the agitating plate contacts the inner wall on the right and left sides. However, in the case where another bending point 1404 is provided at approximately the center of the agitating member as in the present example, the two agitating plates 1401 and 1402 can continue the turning with the bending point acting as the fulcrum. As a result, the area is enlarged further as shown by the hatching in FIG. 15B, and the ink is agitated efficiently and evenly throughout the interior of the ink tank.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-255198 filed Sep. 2, 2005, which is hereby incorporated by reference herein in its entirety.

What is claimed is:

1. A liquid container comprising:

a liquid containing portion adapted to contain a liquid;

a supplying portion facilitating supplying the liquid from the liquid containing portion to outside; and an agitating member configured to agitate the liquid, wherein the agitating member comprises a first side rotatably supported on an inner wall of the liquid containing portion, a second side opposed to the first side and constituted so as to be displaced more largely than the first side and a bending portion provided between the first side and the second side, and wherein the agitating member is displaced in accordance with movement of the liquid containing portion with the first side and the bending portion as fulcrums.

2. The liquid container according to claim 1, wherein the bending portion of the agitating member is formed by a flexible member.

3. The liquid container according to claim 1, wherein an inner volume of the liquid containing portion decreases as the liquid is consumed.

4. The liquid container according to claim 3, wherein the agitating member is further displaced when the bending portion bends after the second side of the agitating member contacts the liquid containing portion, so as to agitate the liquid.

5. The liquid container according to claim 1, further comprising a plurality of the agitating members.

6. The liquid container according to claim 1, wherein the liquid containing portion contains pigment ink.

* * * * *